US006068760A

United States Patent [19]

Benham et al.

[11] Patent Number: 6,068,760

[45] Date of Patent: May 30, 2000

[54] CATALYST/WAX SEPARATION DEVICE FOR SLURRY FISCHER-TROPSCH REACTOR

[75] Inventors: Charles B. Benham, Littleton; Dennis L. Yakobson, Arvada; Mark S. Bohn, Golden, all of Colo.

[73] Assignee: Rentech, Inc., Denver, Colo.

[21] Appl. No.: 09/130,457

[22] Filed: Aug. 7, 1998

Related U.S. Application Data

[60] Provisional application No. 60/055,063, Aug. 8, 1997.

[51] Int. Cl.[7] ..... C07C 27/00

[52] U.S. Cl. ..... 208/950; 518/700; 518/705; 518/709; 518/715; 585/921

[58] Field of Search ..... 518/709, 715, 518/700, 705; 208/950; 585/921

[56] References Cited

U.S. PATENT DOCUMENTS

| | | | |
|---|---|---|---|
| 5,811,469 | 9/1998 | Leviness et al. | 518/700 |
| 5,817,702 | 10/1998 | Behrmann et al. | 518/700 |
| 5,827,903 | 10/1998 | White et al. | 518/710 |

OTHER PUBLICATIONS

Status Review of Fischer–Tropsch Slurry Reactor/Catalyst Wax Separation Techniques prepared for the U.S. Department of Energy, Pittsburgh Energy Technology Center by P.Z. Zhou, Burns and Roe Services Corporation, Feb., 1991.

*Primary Examiner*—Paul J. Killos
*Assistant Examiner*—J. Parsa
*Attorney, Agent, or Firm*—Shoemaker and Mattare, Ltd.

[57] ABSTRACT

Catalyst particles are separated from the wax in a Fischer-Tropsch reactor by feeding a portion of the reactor slurry to a dynamic settler which does not require any pump. As the slurry flows down a pipe in the center of the settler, the slurry flows into the surrounding annular region at the bottom of the settler. The heavier catalyst particles settle down and are removed as the slurry at the bottom of the settler is recycled back to the reactor. The wax rises up in the annular section and this clarified wax is removed by a wax outlet pipe. In an embodiment with an expanded diameter section above the Fischer-Tropsch reactor an additional dynamic settler can be placed inside this section. The Fischer-Tropsch catalyst can be regenerated by purging the catalyst with an inert gas for a period of time and by treating the catalyst with naphtha.

3 Claims, 4 Drawing Sheets

CATALYST/WAX SEPARATION DEVICE FOR SLURRY FISCHER-TROPSCH REACTOR

This application claims the priority benefit of Provisional application Ser. No. 60/055,063 filed on Aug. 8, 1997.

BACKGROUND OF THE INVENTION

1. Field of the Invention

This invention relates to the application of Fischer-Tropsch chemistry to conversion of synthesis gas (hydrogen and carbon monoxide) to liquid hydrocarbons. In particular it relates to a Fischer-Tropsch reactor wherein the gases react in a slurry of catalyst powder suspended in molten wax. Such a slurry reactor has associated with it special problems in removing wax products from the reactor without removing fine catalyst particles as well.

2. Description of the Previously Published Art

In a slurry reactor in which a mixture of hydrogen and carbon monoxide are reacted on a powdered catalyst to form liquid hydrocarbons and waxes (Fischer-Tropsch reaction), the slurry is maintained at a constant level by continuously or intermittently removing wax from the reactor. The problem with wax removal is that catalyst in the wax must be separated from the slurry and returned to the reactor to maintain a constant inventory of catalyst in the reactor. Also, in order to keep the catalyst losses within the required replacement rate due to deactivation, the clarified wax removed from the system must not contain more than about 0.25% catalyst by weight. Several means have been proposed for separating the catalyst from the wax, e.g., centrifuges, cross-flow sintered metal filters, magnetic separators, etc.

The separation task is the most challenging when the catalyst produces free carbon and/or when particles break down during operation to produce "fines" which are submicron in size. In this case, it has been found that the small particles clog sintered metal filters to the point that back washing is ineffective. Also, centrifuges have been found unsuccessful in reducing the catalyst concentration below about 1% by weight in the clarified wax being removed.

Several methods have been described for separating catalyst particles from Fischer-Tropsch wax. A comprehensive report on the subject in entitled "Status Review of Fischer-Tropsch Slurry Reactor/Catalyst Wax Separation Techniques" prepared for the U.S. Department of Energy, Pittsburgh Energy Technology center by P. Z. Zhou, Burns and Roe Services Corporation, February, 1991. In this document are described filters, magnetic separators and settling devices, most of which were not successful or were not deemed commercially viable.

3. Objects of the Invention

It is an object of the invention is to provide an improved process for separating wax and catalyst whereby a relatively clean wax can be removed from the slurry reactor and the catalyst can be returned to the reactor without being subjected to attrition from a mechanical pump.

It is a further object of this invention to provide a catalyst particle separation device where the catalyst slurry obtains momentum as a jet as it issues from the feed conduit into the settler and where this momentum carries the catalyst particles in the settler in a direction opposite to that of the wax being removed from the settler.

It is a further object of this invention to provide a settler design where the combination of high upward velocities and a wire mesh filter within the settler enables the size and number of dynamic settlers to be reduced dramatically.

It is a further object of this invention to provide an expanded diameter section in a Fischer-Tropsch reactor which serves as a catalyst disengaging section so that the number of settlers required to remove wax of a specific clarity is reduced.

It is a further object of this invention to regenerate and increases the activity of a Fischer-Tropsch catalyst as well as to restore and maintain the selectivity of the catalyst by purging the catalyst with an inert gas for a period of time.

It is a further object of this invention to maintain the activity and selectivity of the catalyst more nearly constant over time in a slurry Fischer-Tropsch reactor by washing the catalyst with naphtha.

It is a further object of the invention to provide a means for using the settler return flow to impart an upward velocity to the slurry within the bubble column reactor thereby enabling larger catalyst particles to be used in the reactor. Larger catalyst particles enhance the performance of the dynamic settler.

It is a further object of the invention to provide a separate natural circulation conduit for recirculating a larger amount of slurry to the bottom of the reactor, whereby a larger upward velocity of the slurry in the reactor can be produced.

It is a further object of the invention to provide a separate liquid injection port at the bottom of the reactor whereby naphtha or other liquids from an outside source can be pumped into the reactor for imparting an upward velocity to the slurry in the reactor and for regenerating the catalyst. If olefinic Fischer-Tropsch naphtha is used then the naphtha can undergo additional chain growth to produce more diesel fuel.

These and further objects of the invention will become apparent as the description of the invention proceeds.

SUMMARY OF THE INVENTION

A dynamic settler apparatus is used for catalyst and wax separation from a slurry in a Fischer-Tropsch (F-T) reactor. A portion of the reaction slurry containing wax and the catalyst particles is removed for catalyst separation by feeding the slurry to at least one dynamic settler. The settler has a sealed vertical chamber into which a vertical feed conduit extends downwardly into the settler chamber for a substantial length so as to form an annular region-between the inner walls of the chamber and the feed conduit. At the lower portion of the settler chamber there is a slurry removal outlet for removal of the slurry to be returned back to the F-T reactor. As the slurry flows into the annular region at the bottom of the settler the heavier catalyst particles are carried down and are removed as the slurry at the bottom of the settler is recycled back to the reactor. The wax rises up in the annular section and this clarified wax is removed by a wax outlet pipe at the top. The outlet pipe can optionally have a filter to further purify the wax.

In another embodiment the upper portion of the F-T reactor can have an expanded section for removal of the catalyst slurry since the slurry in this region has a lower catalyst concentration. This expanded diameter section above the reaction zone can also have a further internal dynamic settler positioned inside and the wax removed in the upper portion of the annular zone can be sent to an external dynamic settler for improved results.

The Fischer-Tropsch catalyst can be regenerated and have its activity increased as well as restoring and maintaining the selectivity of the catalyst by purging the slurry with an inert gas for a period of time.

The activity and selectivity of an iron-based or cobalt-based catalyst for a slurry phase F-T reactor can be maintained by treating the catalyst with naphtha.

In another embodiment of the invention, the settler return flow can enter the bottom of the reactor to impart an upward velocity to the slurry within the reactor thereby aiding in fluidizing larger catalyst particles.

In another embodiment a separate external conduit can be provided to increase the flowrate of slurry returned to the bottom of the reactor by natural circulation.

In another embodiment a pump can be provided to add liquid to the bottom of the reactor from an external source such as naphtha for catalyst regeneration and catalyst fluidization.

DESCRIPTION OF THE PREFERRED EMBODIMENTS

If the catalyst particles to be separated are sufficiently large and do not attrit during operation or to the grinding action of a mechanical pump, then conventional filters, either of the sintered metal cross-flow type (manufactured by Mott Metallurgical) or of the wire mash type (manufactured by Pall Filter Corp.) can be used.

However, when there are small, i.e. submicron, catalyst particles present, filtration becomes a challenge. The challenge becomes even greater when the catalyst contains and/or is mixed with carbon which can permanently plug a sintered metal filter due to the tortuous path of the pores. In this case, it in desirable to use a wire mesh filter which does not have long tortuous pores to plug. With a wire mesh filter, it has been found that the total concentration of catalyst as well as the percentage of "fines" on the filter is important in establishing the required time intervals between back-washings for a given mesh size of the filter. Thus, if a mesh filter is placed within the reactor where the catalyst concentration is greater than say 4% by weight, the filter will require back-washing too frequently. By using upstream of the mesh filter the dynamic settler to be discussed below, the catalyst concentration on the filter can be reduced to below 4% thereby enabling the filter to operate efficiently with longer periods of time between back-washinqs.

Figure 1:
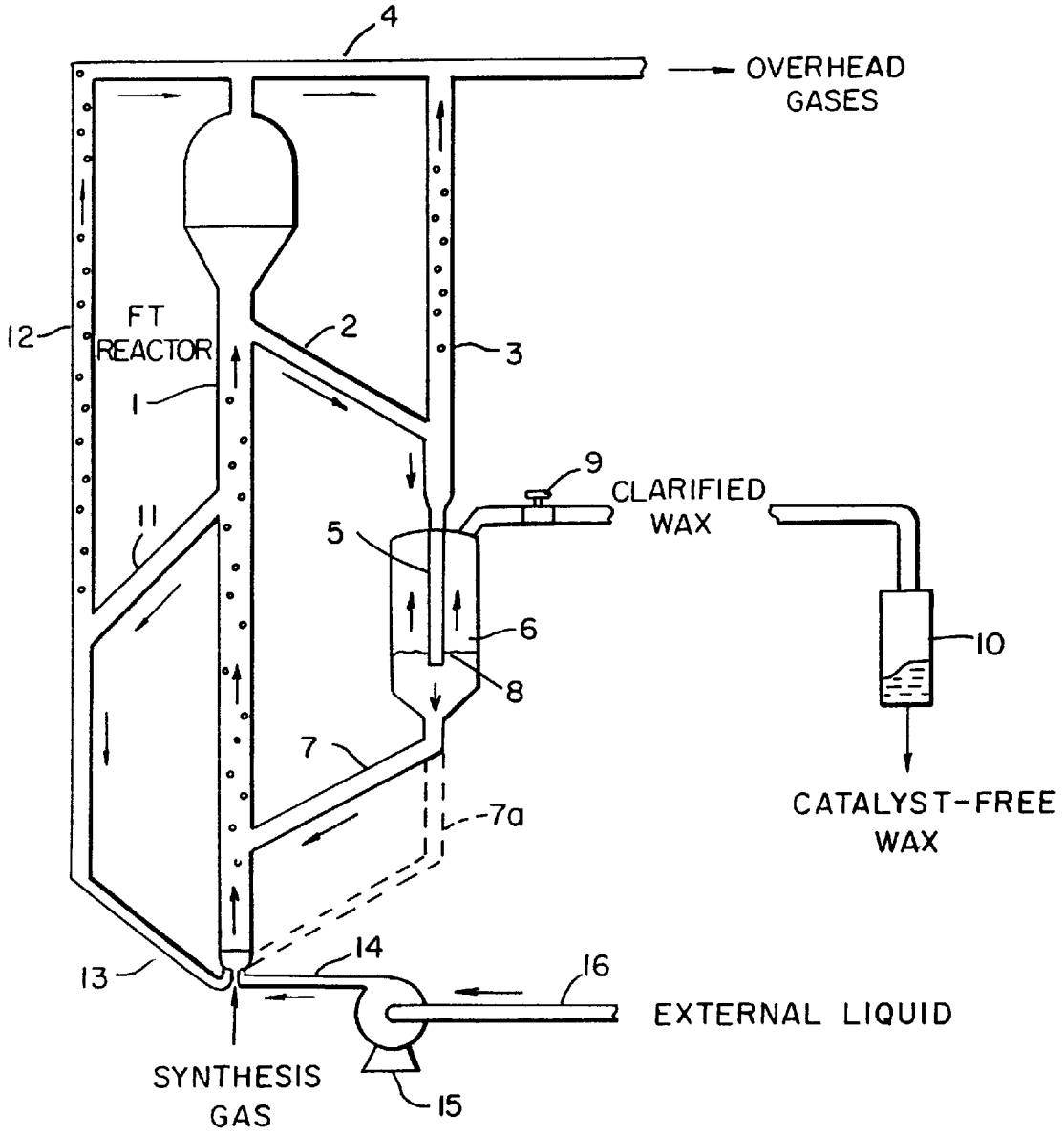
FIG. 1. illustrates a) the slurry reactor, b) the adjacent dynamic settler for separating the catalyst and wax, C) a separate conduit for additional slurry flow driven by natural convection, and d) a separate pump for introducing an external stream of naphtha or other liquid to the bottom of the reactor.

The dynamic settler is a device which accomplishes the desired catalyst/wax separation and simultaneously returns the removed catalyst to the reactor. An important feature of the device is that it is passive, i.e., it requires no pumps for moving the slurry through the system. Referring to FIG. 1, the three-phase mixture in slurry reactor 1 (sometimes referred to as a bubble column reactor) flows into overflow pipe 2 and thence to vertical disengaging pipe 3. The gas bubbles rise in the gas disengaging pipe 3 and flow into reactor outlet pipe 4. The liquid medium and solid catalyst particles flow downwards in the disengaging pipe 3 and enter pipe 5 which lies on the centerline of the cylindrical dynamic settler 6. Pipe 5 extends about 80% of the length of settler 6. The slurry exits pipe 5 as a free jet, flows into the exit opening of settler 6 and returns to the reactor through pipe 7. The annular region 8 surrounding pipe 5 contains wax which is essentially free from catalyst particles since the particles must undergo a 180° change in direction in order to flow upwards in the annular region. A valve 9 located at the top of settler 6 is used to control the rate of wax removal from the settler. Flow through the settler is maintained by natural circulation created by the difference in hydrostatic head between the gas-free slurry in settler 6 and the bubbly flow in reactor 1.

The efficacy of the device in removing catalyst particles from the slurry is due in part to the momentum of the jet issuing from pipe 5. This momentum carries the particles into pipe 7 in a direction opposite to that of the wax being removed from the device. Therefore, not only is gravity causing the particles to move downward, but also the momentum of the jet. Once the particles have been separated from the jet, the clarity of the wax being removed is determined by the upward velocity of the wax in the annular region 8, i.e., a lower velocity entrains fewer particles than a higher velocity due to the lower drag force on the particles. Therefore, for a specified flow rate of wax to be removed, a diameter of settler 6 can be selected to give a sufficiently low upward velocity for a desired clarity of wax. The other components of the apparatus will be sized so as to produce the described functional result.

Table 1 is a tabulation of test data obtained using dynamic settlers mounted on a small slurry Fischer-Tropsch reactor using an iron-based catalyst which is known to break down into submicron size particles under reaction conditions. Table 1 includes some test data at high upward velocities using water and unreacted catalyst. The data shows the effect of upward velocity on the clarity of liquid removed from the separation device.

TABLE 1

Liquid/Catalyst Separation Test Data

| Test | Settler Dia. (Cm) | Velocity (Cm/h) | % Catalyst |
|---|---|---|---|
| Wax/Cat | 10.2 | 1.1 | 0.04 |
| Wax/Cat | 10.2 | 1.6 | 0.07 |
| Wax/Cat | 10.2 | 5.9 | 0.16 |
| Hot Water/Cat | 5.1 | 37.4 | 1.98 |
| Hot Water/Cat | 5.1 | 78.2 | 3.45 |
| Cold Water/Cat | 5.1 | 129.9 | 4.75 |
| Cold Water/Cat | 5.1 | 65.3 | 3.69 |
| Cold Water/Cat | 10.2 | 40.0 | 4.33 |
| Cold Water/Cat | 10.2 | 120.0 | 6.54 |
| Cold Water/Cat | 10.2 | 40.0 | 5.00 |
| Cold Water/Cat | 10.2 | 40.0 | 4.81 |

It can be observed in Table 1 that the catalyst content of the clarified liquid is rather high at high upward velocities in the settler. In order to remove the remaining catalyst in the clarified wax, a clay filter or a mesh filter #10 will be required. However, if a clay filter is used, the catalyst cannot be recovered and returned to the reactor. Thus, in order to keep the catalyst losses to an acceptably low level, the upward velocity in the settlers must be kept below about 6 cm/h. This low upward velocity requirement translates into a requirement for a very large number of settlers arranged in parallel to accommodate the wax production in a commercial reactor.

Figure 2:
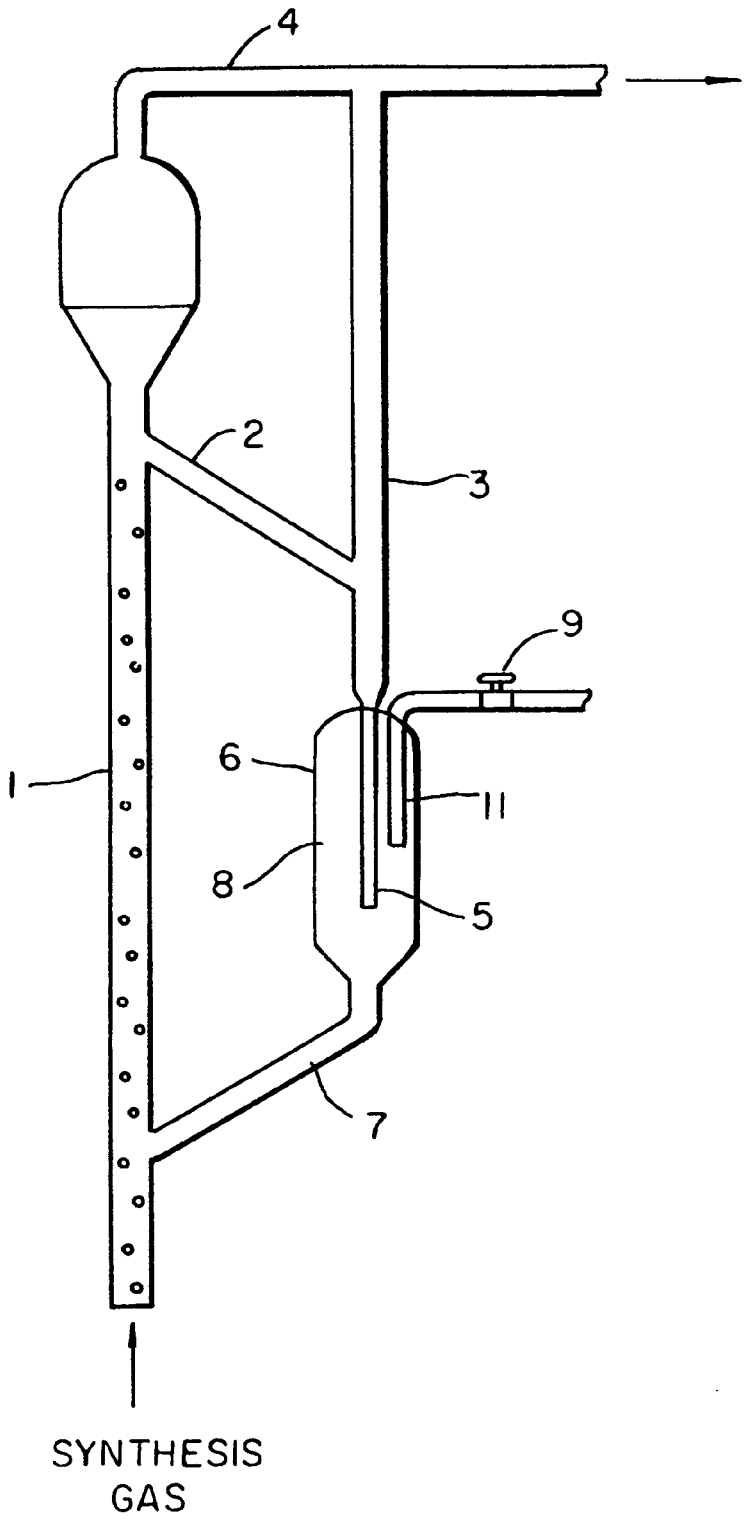
FIG. 2 illustrates the system of FIG. 1 with an additional wire mesh filter in the settler.

A serendipitous solution to the aforementioned dilemma was found by employing a wire mesh filter 11 (shown in FIG. 2) within the annular region of the dynamic settler. Such a wire mesh filter is marketed by Pall Corporation under the trade name Rigimesh. The wire mesh filter does not have tortuous paths of fine pores in which submicron particles can become lodged as does a sintered metal filter. However, the very small particles which are found in the annular region of the dynamic settler do not build up a filter cake on the wire mesh filter readily unless the concentration of particles is above about 2% by weight. If the concentration of catalyst is high, e.g., 10%, then the frequency of back-washing the filter will be too high. The high upward velocities in the settler which give excessively high catalyst losses without a filter, are ideal for use with a wire mesh filter. Therefore, this combination of high upward velocities and a wire mesh filter within the settler enables the size and number of dynamic settlers to be reduced dramatically.

If the catalyst particles do not break down to form submicron particles, e.g., a catalyst deposited on alumina or other refractory support, and free carbon is not produced in the reaction, a sintered metal filter can be mounted in the annular space inside the separation device in place of the wire mesh filter. In this case, a high filtration rate can be achieved due to the low catalyst concentration in the vicinity of the filter.

It is not necessary to place the filters inside the dynamic settlers. It may be found advantageous to combine the flows of clarified wax from several settlers before filtering in a separate filter. In this case, pairs of filters can be arranged in parallel for isolation and maintenance of one of the filters while the other filter remains in operation.

One other arrangement in lieu of external dynamic settlers is an array of internal settlers located in a region within the Fischer-Tropsch reactor above the cooling tubes or intermingled with the cooling tubes. This arrangement has the advantage of not requiring heat tracing of the settlers.

In addition to the dynamic settler feature, the following additional features can be employed to reduce the number of settlers and to improve the performance of the overall system.

When large amounts of wax are produced in a slurry Fischer-Tropsch (F-T) reactor operating in a high-wax production mode, then a preferred embodiment is to remove the slurry from the reactor in an expanded diameter section above the reaction zone in the catalyst disengaging section. The slurry which is removed in this disengaging zone will be less agitated than the slurry in the smaller diameter reacting zone. Therefore, less catalyst will reside in this expanded zone. Preferably, the diameter of the larger disengaging zone should be at least about 20% greater than that of the smaller reacting zone. More preferably, the increase in diameter should be at least about 40%.

Figure 3:
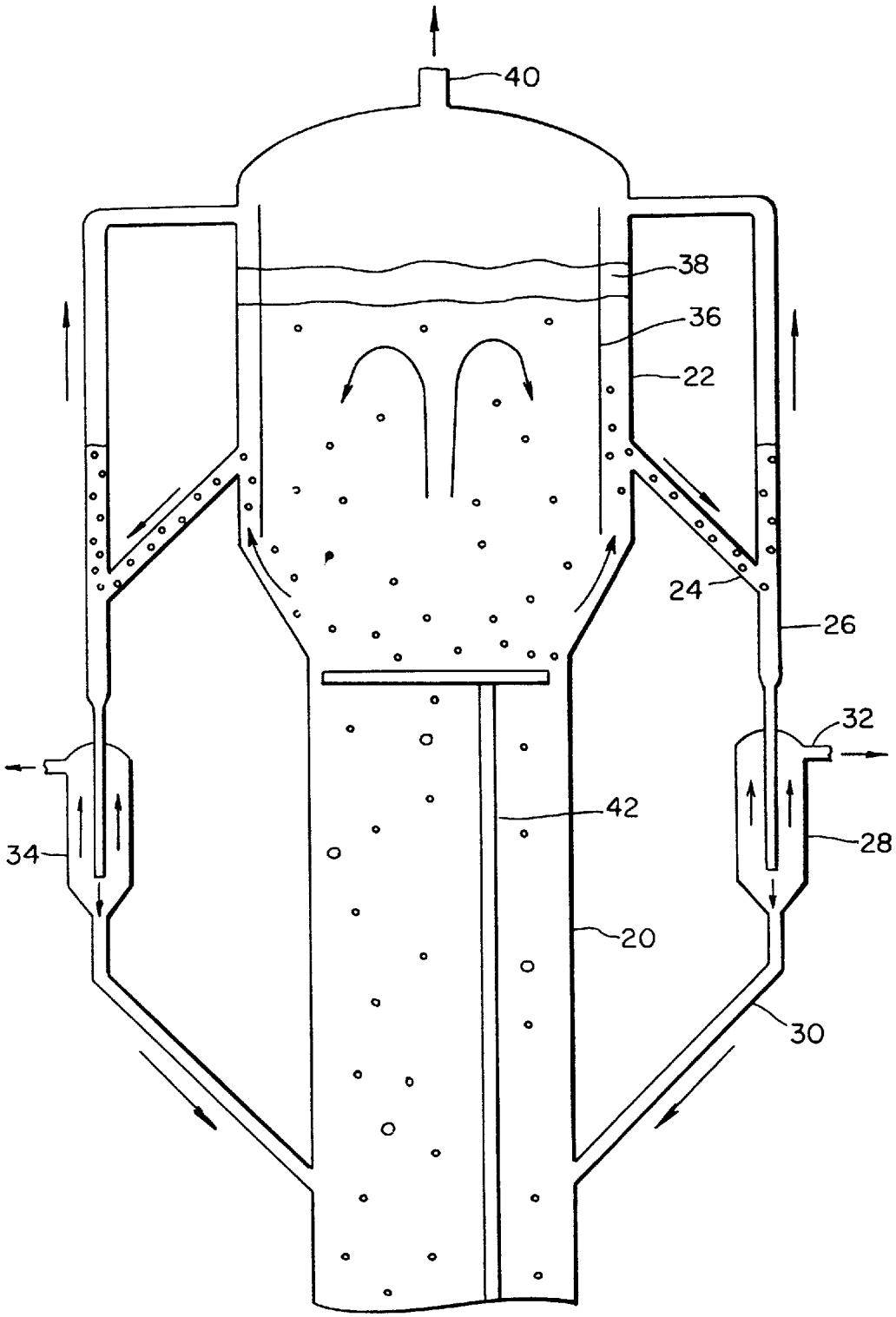
FIG. 3 illustrates a slurry reactor with an expanded diameter section from which the slurry is removed and it also illustrates the use of more than one dynamic settler.

FIG. 3 illustrates a reactor 20 where a three-phase mixture of wax, catalyst and gas bubbles leaving the expanded diameter section 22 through slurry outlet pipe 24 and flowing into a gas disengaging pipe 26 where the bubbles flow upward into the gas space at the top of the expanded section 22. The degassed slurry flows downward into the settler 28 and through the slurry return pipe 30 to the slurry bubble column reactor 20 under natural convection due to the higher density of the degassed slurry over that of the bubble-laden slurry in the reactor. Clarified wax is removed from the settler through wax outlet pipe 32. A second settler 34 with the same structure is shown on the other side of the reactor.

A concentric cylindrical baffle 36 extends from the top of the expanded section above the foam layer 38 (which occurs at the top of the slurry bed due to bubbles broaching the surface of the slurry) down below the outlet ports to the settlers. This baffle prevents catalyst particles from flowing downward along the wall into the outlet pipes to the settlers due to recirculation currents caused by upward flow of slurry along the centerline as shown in FIG. 3. The baffle in most effective when positioned close to the expanded section wall, i.e. approximately 6 inches or less. Configurations other than a cylindrical baffle can be employed, such as individual baffles for each settler port provided that flow of slurry from the top or sides into the ports in prevented. The top of the expanded section has the reactor outlet pipe 40 to remove the gases.

A heat exchanger 42 shown in FIG. 3 with one cooling tube for clarity to remove the exothermic heat generated in the smaller diameter reaction zone is not required in the expanded section since the concentration of reactants and catalyst are too low for a substantial exothermic reaction to take place. However, the heat exchanger can be extended into the expanded section or a separate heat exchanger can be placed in this section and still be within the scope of this invention.

By using this expanded diameter embodiment in the catalyst disengaging section, the number of settlers required to remove the wax of a specific clarity is reduced.

Figure 4:
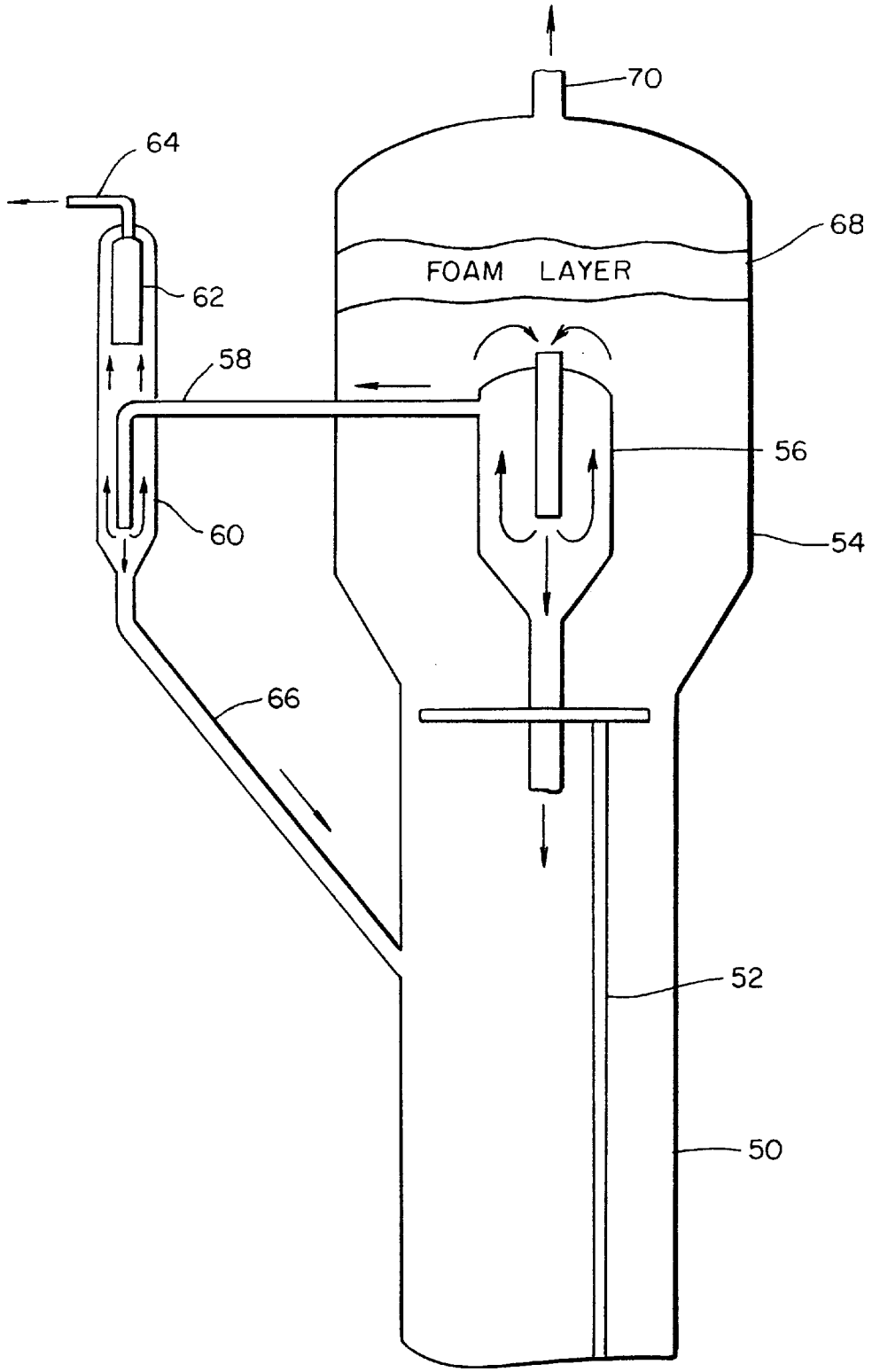
FIG. 4 illustrates a slurry reactor with an expanded diameter section having an internal dynamic settler in that section as well as an external dynamic settler.

A further embodiment illustrated in FIG. 4 uses an internal settler in the upper expanded section in combination with an external settler for housing the wire mesh filter so that the catalyst and wax from the filter can be returned to the reactor using natural circulation without a pump.

In FIG. 4 the column reactor has a cooling heat exchanger 52 with one tube shown for clarity and an upper expanded section 54. In this expanded section is an internal settler 56 with the structure previously described. The wax concentrated slurry leaving the settler flows through slurry outlet pipe 58 to an external settler 60. In the top of the external settler is the wire mesh filter 62 as in the structure shown in FIG. 2 with filter 11. The clean wax leaves via the clean wax outlet pipe 64 and the wax and catalyst slurry returns to the reactor via slurry return line 66. In the expanded upper section the foam layer is shown as 68 and the gases leave via reactor outlet pipe 70.

A further embodiment of the invention which regenerates and increases the activity of the catalyst as well as restoring and maintaining the selectivity of the catalyst is to purge the reactor with an inert gas for a period of time. After the catalyst has been under operation for a few weeks, there is generally a reduction in activity and a shift in selectivity to lighter products, i.e. less wax production. This purging restores some of the activity and selectivity of the catalyst. Examples of inert gases which can be used are nitrogen, carbon dioxide, methane, or even hydrogen that may be readily available at the plant site.

To be most effective, the purging should be carried out at operating temperature and atmospheric pressure in order to maximize the difference between the partial pressure of the heavy waxes and other products on the catalyst surface and the partial pressure of these species in the inert gas phase. In some cases it may be preferable to treat a slipstream of slurry on a continuous basis rather than purging the entire reactor contents in situ. If a slipstream is to be treated, an effective approach would be to use supercritical $CO_2$, i.e. carbon dioxide under supercritical conditions (>31° C. and >1073 psia).

A further embodiment which aids in maintaining the activity and selectivity of the catalyst more nearly constant over time in a slurry F-T reactor is to wash the catalyst with naphtha.

It was discovered during a test in which F-T naphtha which had been caustic washed was recycled back into a slurry F-T reactor that the activity of the catalyst was more nearly constant with time than in a comparable test without naphtha injection. We believe that neutralization of F-T naphtha which has been produced by using an iron-based F-T catalyst is essential since tests have shown that the naphtha fraction produced by using an iron-based F-T catalyst contains a large amount of oxygenates including acids such as acetic acid which could be detrimental to the catalyst in high concentrations. Commercially available naphtha or naphtha produced using a cobalt-based F-T catalyst can be used without neutralization.

The catalyst can be treated with naphtha in either of two embodiments. In one, the naphtha is injected directly into the F-T reactor under operating conditions. When using an iron-based F-T catalyst, the hydrocarbon product contains a high percentage of olefins which can readsorb on the catalyst surface and continue growing into longer-chain hydrocarbons if injected back into the reactor slurry. Therefore, if the naphtha has less value than diesel fuel, it may be desirable to recycle some of the naphtha back into the reactor to reduce the amount of naphtha and increase the amount of diesel fraction produced.

In the second embodiment, a slipstream of slurry is treated with naphtha under non-reacting conditions, e. q. at a lower pressure and higher temperature without synthesis gas. Under this second embodiment, conditions for naphtha treatment can be selected which are the most effective for catalyst regeneration.

Again referring to FIG. 1, an additional pipe 11 can be used to remove slurry from reactor 1 and the slurry can be degassed in line 12 communicating with exit line 4. The bubble-free slurry can flow under natural circulation in conduit 13 to the bottom of reactor 1 thereby imparting a greater upward velocity to the slurry in the reactor. An external source of naphtha or other liquid can be fed by pump 15 through line 14 to the bottom of the reactor for catalyst regeneration and additional fluidization of larger catalyst particles. Since the liquid added via pump 15 contains no catalyst, the pumping action does not cause attrition of the catalyst.

With this additional upward flow larger size particles can be employed in the range of from about 75–150 microns. The size will vary according to the density of the particles with the smaller size of 75 microns for the denser particles and up to 150 microns for the less dense particles. The flow rates employed will depend on Stokes Law and can be determined by routine experimentation with various particle sizes and densities.

In another embodiment, the return line 7 from the dynamic settler can be extended down as shown by dotted line 7*a* to the bottom of the reactor 1. The hot slurry returned to the bottom of the reactor also heats the bottom region of the reactor which is normally cooler due to cooling by the lower temperature synthesis gas entering the reactor.

It is understood that the foregoing detailed description is given merely by way of illustration and that many variations may be made therein without departing from the spirit of this invention.

What is claimed is:

1. A method for separating catalyst particles from wax in a reaction slurry in a Fischer-Tropsch reactor comprising:

a) removing a portion of the reaction slurry containing the wax and catalyst particles from the reactor for separation in a dynamic settler;

b) feeding the removed reaction slurry into a vertical feed conduit extending downwardly into a sealed vertical dynamic settler chamber a substantial length so as to form an annular region between the inner walls of the chamber and the feed conduit, whereby as the slurry flows into the annular region at the bottom of the settler the heavier catalyst particles settle down and are removed as the slurry at the bottom of the settler is recycled back to the reactor while the wax rises up in the annular section and this clarified wax is removed by a wax outlet pipe; and c) optionally further filtering the clarified wax in the wax outlet pipe.

2. A method for separating catalyst particles from wax in a reaction slurry in a Fischer-Tropsch reactor according to claim 1, further comprises recycling the slurry in the Fischer-Tropsch reactor to the reactor gas inlet whereby larger catalyst particles can be used with improved separation of the catalyst particles from the wax in the dynamic settler.

3. A method according to claim wherein additional liquid is supplied to the Fischer-Tropsch reactor at the reactor gas inlet whereby larger catalyst particles can be used with improved separation of the catalyst particles from the wax in the dynamic settler.

* * * * *